US006491831B1

(12) United States Patent
Aibara

(10) Patent No.: US 6,491,831 B1
(45) Date of Patent: Dec. 10, 2002

(54) METHOD OF MAKING A SHADOW MASK FOR A CATHODE RAY TUBE

(75) Inventor: Nobumitsu Aibara, Shiga (JP)

(73) Assignee: NEC Corporation, Tokyo (JP)

( * ) Notice: Subject to any disclaimer, the term of this patent is extended or adjusted under 35 U.S.C. 154(b) by 205 days.

(21) Appl. No.: 09/618,099

(22) Filed: Jul. 17, 2000

Related U.S. Application Data

(62) Division of application No. 09/028,658, filed on Feb. 24, 1998, now Pat. No. 6,175,185.

(30) Foreign Application Priority Data

Feb. 26, 1997 (JP) ..... 9-041722

(51) Int. Cl.[7] ..... H01J 29/80

(52) U.S. Cl. ..... 216/12; 216/41; 216/56; 430/4; 430/5; 430/23; 430/24; 430/313; 313/402; 313/403; 313/407

(58) Field of Search ..... 216/12, 41, 56; 430/23, 4, 313, 24, 5

(56) References Cited

U.S. PATENT DOCUMENTS 5,526,950 A * 6/1996 Tago et al. ..... 216/12
5,635,320 A 6/1997 Ohtake et al.

FOREIGN PATENT DOCUMENTS

JP 7-65738 3/1995
JP 7-114885 5/1996

* cited by examiner

*Primary Examiner*—Randy Gulakowski
*Assistant Examiner*—Gentle E. Winter
(74) *Attorney, Agent, or Firm*—Young & Thompson

(57) ABSTRACT

A shadow mask for a cathode ray tube includes through-holes defined by first and second recessed formed at first and second surfaces of the shadow mask, respectively. Each through-hole has a first wall farther away from a center of the shadow mask than a second wall thereof. The second recess has a smaller size than that of the first recess. The first wall is formed of a first wall portion defined by an inner surface of the first recess and a second wall portion defined by an inner surface of the second recess. The second wall portion of through-holes located at a peripheral region of the first region has a configuration such that electron beams reflected therefrom are directed to an inner surface of the first recess to thereby reduce electron beams reflected therefrom in directions different from a direction in which the electron beams are originally directed before the electron beams enter the shadow mask.

5 Claims, 4 Drawing Sheets

METHOD OF MAKING A SHADOW MASK FOR A CATHODE RAY TUBE

CROSS-REFERENCE TO RELATED APPLICATIONS

This application is a division of copending application Ser. No. 09/028,658, filed Feb. 24, 1998, now U.S. Pat. No. 6,175,185.

BACKGROUND OF THE INVENTION

1. Field of the Invention

The invention relates to a shadow mask to be used for a cathode ray tube, having a plurality of through-holes, such as dot holes and slot holes, each of which is defined by a greater-size recess formed at a first surface thereof and a smaller-size recess formed at a second surface thereof. The invention further relates to a method of fabricating the shadow mask, and still further to a cathode ray tube including the shadow mask.

2. Description of the Related Art

One of conventional color cathode ray tubes has been suggested in Japanese Unexamined Patent Publication No. 7-65738. FIG. 1 illustrates the suggested color cathode ray tube. The illustrated color cathode ray tube 11 includes a bulb 12 having a face panel 13 constituting a front surface of the bulb 12, and a neck portion 12*a*, a fluorescent film 14 formed on an inner surface of the face panel 13, a shadow mask 15 disposed in facing relation with the fluorescent film 14 and having a plurality of slots, an electron gun 16 disposed in the neck portion 12*a* of the bulb 12, and a deflecting yoke 18 disposed around the neck portion 12*a* of the bulb 12 for deflecting electron beams 7 emitted from the electron gun 16.

In operation, the electron gun 16 emits the electron beam 7, which is deflected by a magnetic field generated by the deflecting yoke 18. The deflected electron beam 7 passes through the shadow mask 15, and scans the fluorescent film 14 therewith. In accordance with the scanning path, a certain image is produced on the fluorescent film 14.

In order to enhance basic characteristics expected in an image display device, such as contrast and brightness, the color cathode ray tube is designed to include, on an inner surface of the pace panel 13, a black matrix film (not illustrated) comprising non-luminous light-absorbing material, such as black carbon, filling spaces formed between red, green and blue fluorescent luminous pixels, and a metal back film (not illustrated) which is made of an aluminum film and which reflects light independently of the fluorescent film 14. The above-mentioned fluorescent film 14 is integrally formed with the black matrix film. The shadow mask 15 is disposed in facing relation with the metal back film.

Hereinbelow is explained the shadow mask 15 having a plurality of rectangular slots through which the electron beam 7 passes.

As illustrated in FIG. 2, the shadow mask 15 is formed with a plurality of slots 22 each of which has a longer side in a direction of a vertical axis V and a shorter side in a direction of a horizontal axis H. Bridge portions 23 are formed between the adjacent slots 22 in the vertical axis V direction, and connecting portions 24 are formed between the adjacent slots 22 in the horizontal axis H direction.

Each of the slots 22 is a through-hole comprised of a first recess 25 formed at a first surface of the shadow mask 15, and a second recess 26 formed at a second surface (not seen in FIG. 2) of the shadow mask 15 and having a smaller size than the first recess 25. Herein, the first surface of the shadow mask 15 is defined as a surface facing the fluorescent film 14, and the second surface is defined as a surface facing the electron gun 16. The slots 22 are formed by the steps of forming a first photoresist pattern on a first surface of a thin metal plate for forming the first recess 25, which first photoresist pattern defines a plurality of rectangles each of which has a longer side in the vertical axis V direction and a shorter side in the horizontal axis H direction, forming a second photoresist pattern on a second surface of the thin metal plate for forming the second recess 26, which second photoresist pattern also defines a plurality of rectangles each of which has a longer side in the vertical axis V direction and a shorter side in the horizontal axis H direction where the longer and shorter sides in the second photoresist pattern are shorter than those in the first photoresist pattern, etching the thin metal plate with the first and second photoresist patterns acting as a mask to thereby form the first and second recesses 25 and 26, and removing the first and second photoresist patterns.

FIG. 3 is a cross-sectional view taken along the line III—III in FIG. 2, illustrating a positional relation between the slot 22 and the incident electron beam 7 passing through the slot 22. As illustrated in FIG. 3, if the electron beam 7 partially strikes an inner surface 26*a* of the second recess 26, a part of the electron beam 7 is randomly reflected in a direction different from a direction in which the electron beam 7 is originally directed. If the randomly reflected electron beam 7*a* was directed towards the fluorescent film 14, an undesired image would be generated on the fluorescent film 14 by the randomly reflected electron beam 7*a*, which is a major factor for degrading the contrast of the shadow mask 15.

The electron beam 7 enters, at a greater incident angle, the slot 22 located farther away from a center of the shadow mask 15, and accordingly, is reflected at the inner surface 26*a* of the second recess 26 to greater degree, resulting in that the contrast of the shadow mask 15 is considerably degraded.

SUMMARY OF THE INVENTION

In view of the above-mentioned problem of the conventional shadow mask, it is an object of the present invention to provide a shadow mask capable of reducing electron beams reflected from an inner surface of a through-hole towards a fluorescent film to thereby prevent images from being unnecessarily formed on the fluorescent film. It is also an object of the present invention to provide a method of fabricating the shadow mask, and a cathode ray tube including the shadow mask.

In one aspect of the present invention, there is provided a shadow mask to be used for a cathode ray tube, defining a first region where a plurality of through-holes through which electron beams pass are formed, and a second region where no through-holes are formed. Each of the through-holes is defined by a first recess formed at a first surface of the shadow mask and a second recess formed at a second surface of the shadow mask, and has a first wall farther away from a center of the shadow mask than a second wall thereof. The second recess has a smaller size than that of the first recess. The first wall is formed of a first wall portion defined by an inner surface of the first recess and a second wall portion defined by an inner surface of the second recess. Through-holes located at a marginal region of the first region are designed to have the second wall portion designed to reduce electron beams reflected therefrom in directions different from a direction in which the electron beams are originally directed before the electron beams enter the shadow mask.

For instance, the second wall portion of the through-holes located at a marginal region of the first region may be designed to have such a configuration that electron beams reflected therefrom are directed to an inner surface of the first recess. It is preferable that the inner surface of the first recess is designed to have such a configuration that the electron beams directed thereto are reflected therefrom in a direction in which the electron beams are originally directed.

It is preferable that a first boundary between the first and second recesses within the first wall is located lower than a second boundary between the first and second recesses within the second wall on the basis of a bottom of the second recess. It is preferable that the first boundary has a height equal to or lower than 20 $\mu$m on the basis of a bottom of the second recess.

The second wall portion may be designed to have a configuration defined as a function of a horizontal distance between (a) a first boundary between the first and second recesses within the first wall and (b) an outer edge of the second recess, the horizontal distance being defined as a function of a thickness of the shadow mask, a height of the first boundary, a width of the through-hole, an incident angle of the electron beams at the first boundary, and an inner width of the first recess. For instance, the above-mentioned horizontal distance is defined by the following equation:

$$S3 \geqq H2 \times \tan \beta 1$$

$$\beta 1 = (90 - \alpha - \tan^{-1}((T - H2/(A + S4)))/2$$

wherein: S3 indicates the horizontal distance; H2 indicates a height of the first boundary; $\alpha$ indicates an incident angle of the electron beams entering the through-holes,; T indicates a thickness of the shadow mask; A indicates a width of the through-holes; and S4 indicates a horizontal distance between (a) a boundary between the first and second recesses within the second wall and (b) an outer edge of the first recess.

As an alternative, the second wall portion of the through-holes located at a marginal region of the first region may be designed to have such a configuration that electron beams reflected therefrom are directed not to enter the through-holes.

It is preferable that the second wall portion has a configuration defined as a function of a horizontal distance between (a) a first boundary between the first and second recesses within the first wall and (b) an outer edge of the second recess, the horizontal distance being defined as a function of a thickness of the shadow mask, a height of the first boundary, a width of the through-hole, an incident angle of the electron beams at the first boundary, and an inner width of the first recess. For instance, the above-mentioned horizontal distance is defined by the following equation:

$$S3 \geqq H2 \times \tan \beta 2$$

$$\beta 2 = (90 - \alpha)/2$$

$$\alpha = \tan (S2/H2)^{-}$$

wherein: S3 indicates the horizontal distance; H2 indicates a height of the first boundary; $\alpha$ indicates an incident angle of the electron beams entering the through-holes; and S2 indicates a horizontal distance between (a) a second boundary between the first and second recesses within the second wall and (b) an outer edge of the second recess.

It is preferable that the second recess has a central axis located closer to a center of the shadow mask than a central axis of the first recess by a predetermined distance. The predetermined distance may be a function of a height of the first boundary, a thickness of the shadow mask, and an incident angle of the electron beam entering the shadow mask. It is preferable that the predetermined distance is set equal to or smaller than 50 $\mu$m.

In another aspect of the present invention, there is provided a method of fabricating a shadow mask to be used for a cathode ray tube, including the steps of (a) forming a first photoresist pattern on a first surface of a shadow mask for forming a first recess at the first surface, (b) forming a second photoresist pattern on a second surface of the shadow mask for forming a second recess at the second surface in such a manner that the second recess cooperates with the first recess to thereby from a through-hole throughout a thickness of the shadow mask, that the second recess has a smaller size than that of the first recess, and that the second recess has a central axis located closer to a center of the shadow mask than a central axis of the first recess by a predetermined distance, (c) etching the shadow mask with the first and second photoresist patterns acting as a mask, and (d) removing the first and second photoresist patterns.

For instance, the predetermined distance is preferably set equal to or smaller than 20 $\mu$m.

It is preferable in the step (c) that the shadow mask is etched so that a first boundary between the first and second recesses within a first wall is located lower than a second boundary between the first and second recesses within a second wall on the basis of a bottom of the second recess, the first wall being defined as a wall of the through-hole located farther away from a center of the shadow mask than the second wall. It is also preferable that the shadow mask is etched so that the first boundary has a height equal to or lower than 20 $\mu$m on the basis of a bottom of the second recess. It is preferable that an etching pressure for forming the first recess is different from an etching pressure for forming the second recess.

In still another aspect of the present invention, there is provided a cathode ray tube including (a) a bulb having a face panel constituting a front surface of the bulb, and a neck portion, (b) a fluorescent film formed on an inner surface of the face panel, (c) an electron gun disposed in the neck portion of the bulb, (d) a deflecting yoke disposed around the neck portion of the bulb for deflecting electron beams emitted from the electron gun, and (e) the above-mentioned shadow mask disposed between the fluorescent film and the electron gun.

In accordance with the present invention, it is possible to direct electron beams reflected at the second wall portion in a direction different from a direction in which the electron beams are originally directed. For instance, the electron beams having been reflected at the second wall portion of the first wall are reflected towards an inner surface of the first recess or towards an electron gun. Accordingly, it is possible to prevent images from being unnecessarily formed on the fluorescent film, which ensures to avoid degradation in the contrast characteristic of the shadow mask.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Hereinbelow are explained preferred embodiments in accordance with the present invention. A shadow mask is formed generally with dots, slots, or slits. In the later mentioned embodiments, a shadow mask is designed to have slots. However, it should be noted that the present invention is applicable to a shadow mask having dots, slots or through-holes having other shapes.

First Embodiment

Figure 1:
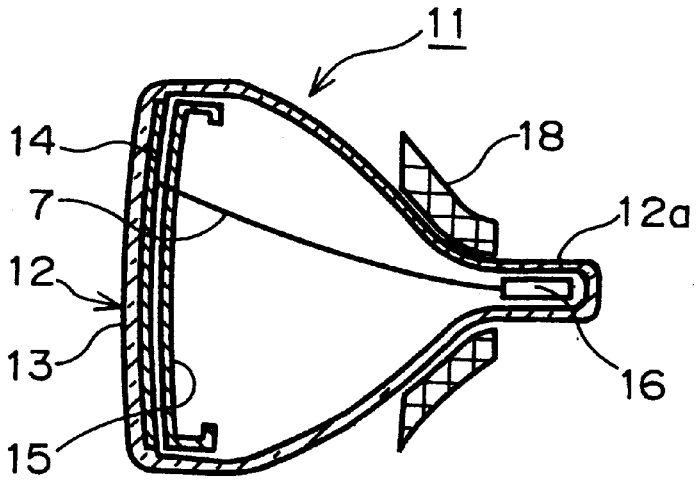
FIG. 1 PRIOR ART
FIG. 1 is a cross-sectional view illustrating a basic structure of a color cathode ray tube.
Figure 2:
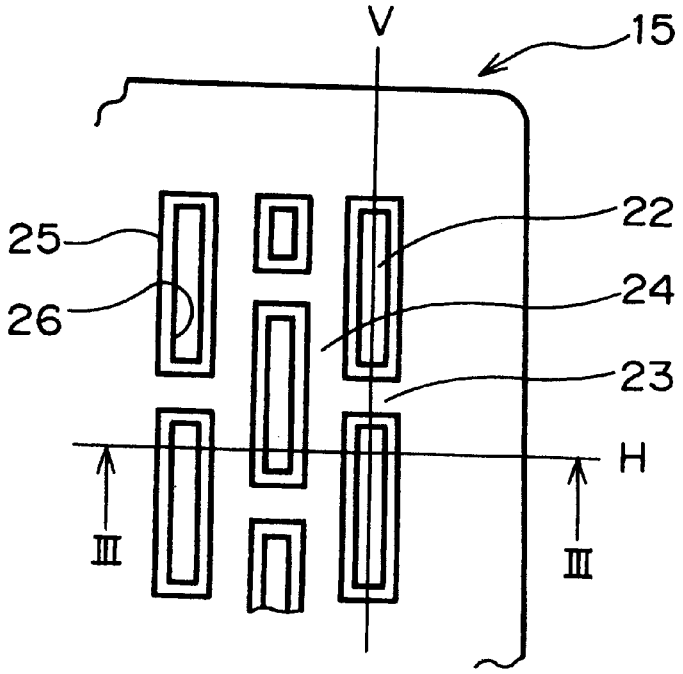
FIG. 2 PRIOR ART
FIG. 2 is a plan view illustrating a conventional shadow mask having a plurality of slots.
Figure 3:
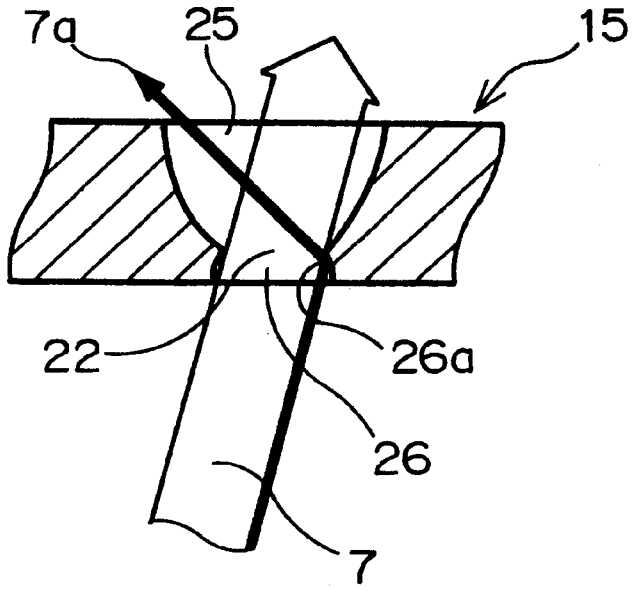
FIG. 3 PRIOR ART
FIG. 3 is a cross-sectional view taken along the line III—III in FIG. 2.

With reference to FIG. 1, a shadow mask 31 in accordance with the first embodiment defines a first region R1 in which a plurality of slots 32 through which electron beams 7 pass are formed, and a second region R2 in which no slots are formed. Each of a plurality of slots 32 has a longer side in a direction of a vertical axis V and a shorter side in a direction of a horizontal axis H. Bridge portions 40 are formed between the adjacent slots 32 in the vertical axis V direction, and connecting portions 41 are formed between the adjacent slots 32 in the horizontal axis H direction.

Figure 5:
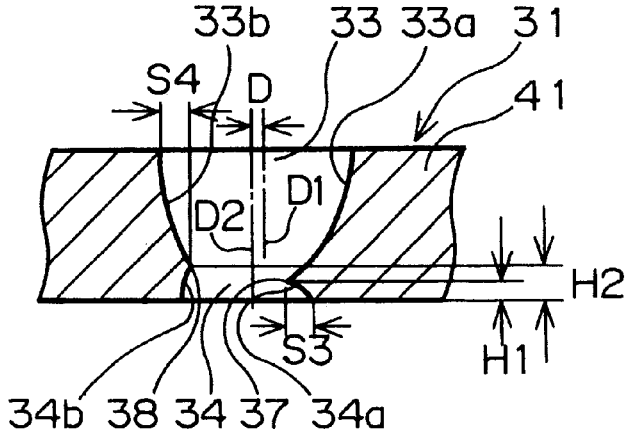
FIG. 5 is a cross-sectional view taken along the line V—V in FIG. 4.

As illustrated in FIG. 5, each of the slots 32 is a through-hole comprised of a first recess 33 formed at a first surface of the shadow mask 1, and a second recess 34 formed at a second surface (not seen in FIG. 1) of the shadow mask 1 and having a smaller size than the first recess 33. Herein, the first surface of the shadow mask 31 is defined as a surface facing a fluorescent film, and the second surface is defined as a surface facing an electron gun.

Figure 4:
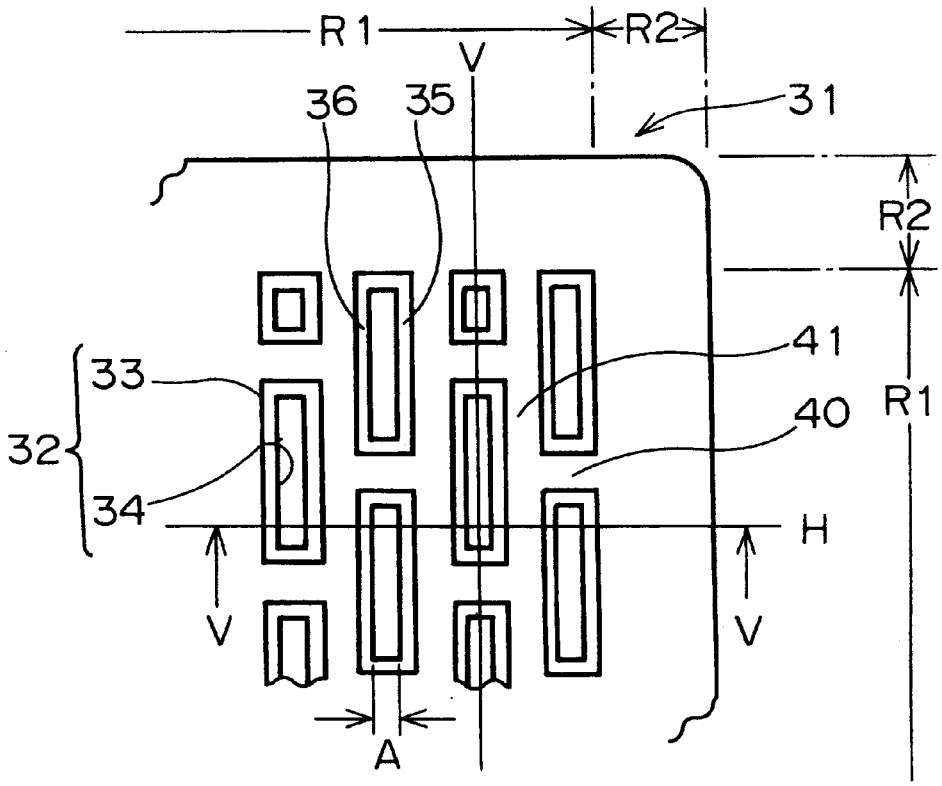
FIG. 4 is a plan view illustrating a shadow mask in accordance with the first embodiment of the present invention.

As illustrated in FIGS. 4 and 5, each of the slots 2 has first and second walls 35 and 36 both extending in the vertical axis V direction. The first wall 35 is located farther away from a center of the shadow mask 31 than the second wall 36. The first wall 35 is constituted of a first external wall portion 33*a* defined by an external inner surface of the first recess 33 and a second external wall portion 34*a* defined by an external inner surface of the second recess 34, and the second wall 36 is constituted of a first internal wall portion 33*b* defined by an internal inner surface of the first recess 33 and a second internal wall portion 34*b* defined by an internal inner surface of the second recess 34.

The first external wall portion 33*a* in the first recess 33 and the second external wall portion 34*a* in the second recess 34 meet each other at a first boundary 37. The first boundary 37 between the first and second recesses 33 and 34 within the first wall 35 has a height H1 measured from a bottom surface of the shadow mask 31. Similarly, the first internal wall portion 33*b* in the first recess 33 and the second internal wall portion 34*b* in the second recess 34 meet each other at a second boundary 38. The second boundary 38 between the first and second recesses 33 and 34 within the second wall 36 has a height H2 measured from a bottom surface of the shadow mask 31.

Each of the slots 32 has a width A, as illustrated in FIG. 4. Herein, a width of the slot 32 is defined as a length measured in the horizontal axis H direction, over which the first and second recesses 33 and 34 overlap.

In FIG. 5, a distance S3 is defined as a distance horizontally measured between the first boundary 37 and an outer edge of the second recess 34, and a distance S4 is defined as a distance horizontally measured between the second boundary 38 and an outer edge of the first recess 33.

In the shadow mask 31 in accordance with the first embodiment, the height H1 is designed to be smaller than the height H2 in the slots 32 located at a marginal region of the first region R1. That is, the first boundary 37 is located lower than the second boundary 38. In addition, the height H2 is arranged equal to or lower than 20 $\mu$m.

Furthermore, the second recess 34 is designed to have a central axis D2 located closer to a center of the shadow mask 31 than a central axis D1 of the first recess 33 by a predetermined distance D. The distance D is a function of the height H1, a thickness T of the shadow mask 31, and an incident angle $\alpha$ of the electron beam 7 entering the slot 32. The distance D varies in dependence on a distance between a center of the shadow mask 31 and the slot 32. Specifically, the distance D is equal to zero in the slot 32 located at a center of the shadow mask 31. The distance D is set greater in a slot 32 located remoter from a center of the shadow mask 31. However, the distance D is not over 50 $\mu$m. Namely, the slot 32 located remotest from a center of the shadow mask 31 has the greatest distance D, 50 $\mu$m.

Figure 6:
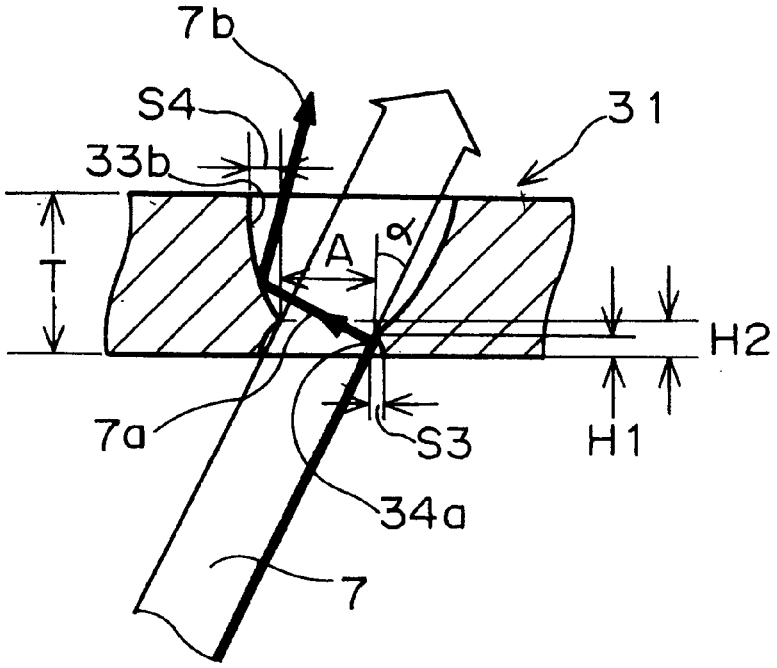
FIG. 6 is a cross-sectional view of a shadow mask in accordance with the first embodiment, illustrating a relation between the shadow mask and reflected electron beams.

In the above-mentioned slots 2 located at a marginal region of the first region R1, the second external wall portion 34*a* reduces the electron beams reflected therefrom in directions different from a direction in which the electron beams 7 are originally directed before the electron beams 7 enter the shadow mask 31. Specifically, the second wall portion 34*a* is designed to have such a configuration that the electron beam 7*a* reflected therefrom is directed to the first internal wall portion 33*b* of first recess 33, as illustrated in FIG. 6. The electron beam 7*a* reflected from the second wall portion 34*a* to the first internal wall portion 33*b* is again reflected at the first internal wall portion 33*b*. The electron beam 7*b* reflected at the first internal wall portion 33*b* is directed in a direction in which the electron beams 7 are originally directed.

The reflected electron beam 7*b* exhausts its energy by reflecting at the first internal wall portion 33*b*, and hence can no longer generate an undesired image on a fluorescent film. Thus, the shadow mask 31 can reduce the electron beams 7 reflected therefrom in directions different from a direction in which the electron beams 7 are originally directed, to thereby avoid that image are unnecessarily generated on a fluorescent film because of randomly reflected electron beams.

The slot 32 is formed generally by the steps of forming a first photoresist pattern on a first surface of a thin metal plate for forming the first recess 33, forming a second photoresist pattern on a second surface of the thin metal plate for forming the second recess 34, etching the thin metal plate with the first and second photoresist patterns acting as a mask to thereby form the first and second recesses 33 and 34, and removing the first and second photoresist patterns. The thus formed first and second recesses 33 and 34 cooperate with each other to thereby define the slot 32. A boundary between the first and second recesses 33 and 34 is a key for forming the slot 32 having a desired configuration.

The condition required for the slot 32 to reflect the electron beam 7 at the second wall portion 34*a* to the first internal wall portion 33*b*, and reflect again the thus reflected electron beam 7*a* in a direction in which the electron beam 7 is originally directed is dependent on the distance S3, which is the distance between the first boundary 37 and an outer edge of the second recess 34. The distance S3 is represented with the following equation (A).

$$S3 \geqq H2 \times \tan \beta 1$$

$$\beta 1 = (90 - \alpha - \tan^{-1}((T - H2/(A + S4)))/2$$

wherein α indicates an incident angle of the electron beams 7 entering the slot 32, T indicates a thickness of the shadow mask 31, A indicates a width of the slot 32, and S4, as mentioned earlier, indicates a horizontal distance between the second boundary 38 and an outer edge of the first recess 33.

The inventor had conducted the experiment for verifying the effectiveness of the shadow mask 31 in accordance with the first embodiment. In the experiment, the height H2 of the second boundary 38 was fixed at 30 μm, the distance D between central axes of the first and second recesses 33 and 34 was equal to 10 μm or 15 μm, and the height H1 was varied in the range of 10 μm to 40 μm. In each of cases, a ratio defined as (X/Y)×100 was calculated, wherein Y indicates an electron beam entering the shadow mask under test, and X indicates an electron beam exiting the shadow mask in the same direction as that of the electron beam entering the shadow mask. The result is as follows.

| No. | H2 [μm] | D [μm] | H1 [μm] | Ratio [%] |
|---|---|---|---|---|
| 1 | 30 | 10 | 10 | 94 |
| 2 | 30 | 10 | 14 | 93 |
| 3 | 30 | 10 | 15 | 93 |
| 4 | 30 | 10 | 18 | 91 |
| 5 | 30 | 15 | 20 | 90 |
| 6 | 30 | 15 | 22 | 75 |
| 7 | 30 | 15 | 25 | 70 |
| 8 | 30 | 15 | 27 | 68 |
| 9 | 30 | 15 | 31 | 60 |
| 10 | 30 | 15 | 37 | 57 |
| 11 | 30 | 15 | 40 | 52 |

The case numbers 1 to 5 are cases in accordance with the first embodiment. As is obvious, they exhibit an extremely higher ratio than the case numbers 6 to 11 that are not in accordance with the first embodiment.

Second Embodiment

Figure 7:
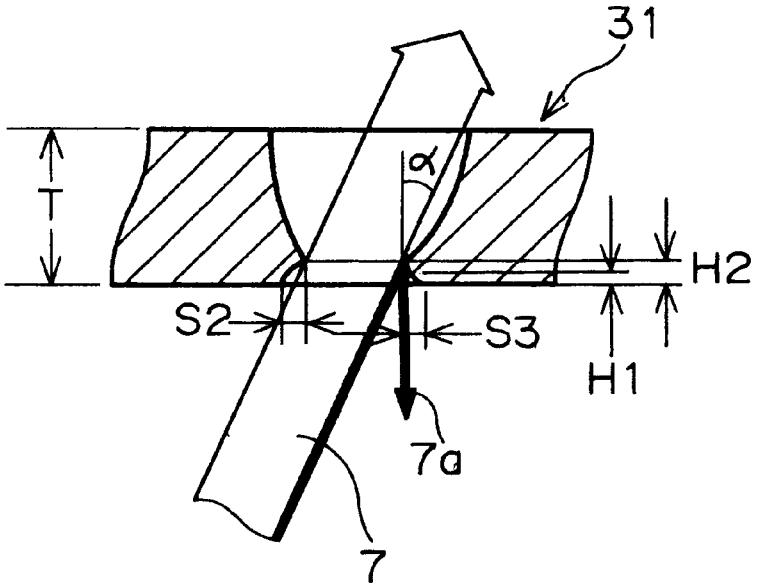
FIG. 7 is a cross-sectional view of a shadow mask in accordance with the second embodiment.

FIG. 7 is a cross-sectional view of a shadow mask in accordance with the second embodiment. The second embodiment is different from the first embodiment only with respect to a configuration of the second wall portion 34*a*. The other elements or parts are common between the first and second embodiments. In the second embodiment, the slots 32 located at a marginal region of the first region R1 are designed to have the second wall portion 34*a* having such a configuration that the electron beams 7*a* reflected therefrom are directed not to enter the slots 32. In other words, the electron beams 7*a* reflected at the second wall portion 34*a* are all directed back to an electron gun.

The condition required for the slot 32 to reflect the electron beam 7 at the second wall portion 34*a* all towards an electron gun is dependent on the distance S3, which is the distance between the first boundary 37 and an outer edge of the second recess 34. The distance S3 is represented with the following equation (B).

$$S3 \geqq H2 \times \tan \beta 2$$

$$\beta 2 = (90 - \alpha)/2$$

$$\alpha = \tan (S2/H2)^{-1}$$

wherein S2 indicates a distance horizontally measured between the second boundary 38 and an outer edge of the second recess 34.

As mentioned above, the shadow masks in accordance with the first and second embodiments are designed to have the second wall portion 34*a* defined with the above-mentioned equations (A) or (B) in order to prevent an image from being unnecessarily generated on a fluorescent film due to electron beams other than the original electron beam 7, such as the reflected electron beam 7*a* and the twice reflected electron beam 7*b*. Though the second wall portion 34*b* may be defined with only one of (a) the equation (A) or (B), (b) the height Hi being greater than the height H2, and (c) the height H1 being equal to or smaller than 20 μm, it is preferable to define the second wall portion 34*b* with all the conditions (a) to (c).

Hereinbelow is explained a method of fabricating the above-mentioned shadow mask in accordance with the first embodiment.

First, a first photoresist pattern is formed on a first surface of a thin metal plate for forming the first recess 33. Then, a second photoresist pattern is formed on a second surface of the thin metal plate for forming the second recess 34 in such a manner that the second recess 34 has a smaller size than that of the first recess 33, and that the second recess 34 has a central axis D2 located closer to a center of the shadow mask 31 than a central axis D1 of the first recess 33 by a distance smaller than the height H1. Then, the thin metal plate is etched with the first and second photoresist patterns acting as a mask. Thus, the first and second recesses 33 and 34 cooperate with each other to thereby from the slot 32 throughout a thickness of the metal plate. An etching pressure for forming the first recess 33 may be different from an etching pressure for forming the second recess 34. Then, the first and second photoresist patterns are removed. Thus, the shadow mask 31 in accordance with the first embodiment is completed.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 9-41722 filed on Feb. 26, 1997 including specification, claims, drawings and summary is incorporated herein by reference in its entirety.

What is claimed is:

1. A method of fabricating a shadow mask to be used for a cathode ray tube, comprising the steps of:

(a) forming a first photoresist pattern on a first surface of a shadow mask for forming a first recess at said first surface;

(b) forming a second photoresist pattern on a second surface of said shadow mask for forming a second recess at said second surface in such a manner that said second recess cooperates with said first recess to thereby form a through-hole throughout a thickness of said shadow mask, said second recess having a smaller size than that of said first recess, and said second recess having a central axis located closer to a center to said shadow mask than a central axis of said first recess by a predetermined distance, the through-hole having a first wall farther from the center of the shadow mask than a second wall thereof, the first wall having a first portion defined by an inner surface of the first recess and a second portion defined by an inner surface of the second recess, the second portion of the first wall being formed with an angle that reflects electron beams entering the through-hole onto an inner surface of the second wall in the first recess to reduce electron beams that are reflected from the second wall in a direction different from a direction of entry into the second recess;

(c) etching said shadow mask with said first and second photoresist patterns acting as a mask; and (d) removing said first and second photoresist patterns.

2. The method as set forth in claim 1, wherein said shadow mask is etched so that a first boundary between said first and second recesses within the first wall is located lower than a second boundary between said first and second recesses within the second wall on the basis of a bottom of said second recess.

3. The method as set forth in claim 2, wherein said shadow mask is etched so that said second boundary has a height equal to or lower than 20 $\mu$m on the basis of a bottom of said second recess.

4. The method as set forth in claim 1, wherein said predetermined distance is equal to or smaller than 50 $\mu$m.

5. The method as set forth in claim 1, wherein an etching pressure for forming said first recess is different from an etching pressure for forming said second recess.

* * * * *